US006374580B1

(12) United States Patent
Kujubu et al.

(10) Patent No.: US 6,374,580 B1
(45) Date of Patent: Apr. 23, 2002

(54) METHOD AND APPARATUS FOR CONTROLLING BAG-FORMING AND-FILLING VACUUM PACKAGING MACHINE

(75) Inventors: Eitaro Kujubu, Mihara; Hiroshi Yoshimoto, Hiroshima-ken, both of (JP)

(73) Assignee: Furukawa Mfg. Co., Ltd. (JP)

( * ) Notice: Subject to any disclaimer, the term of this patent is extended or adjusted under 35 U.S.C. 154(b) by 0 days.

(21) Appl. No.: 09/474,275

(22) Filed: Dec. 29, 1999

(51) Int. Cl.[7] ..... B65B 9/00

(52) U.S. Cl. ..... 53/450; 53/52; 53/55; 53/376.2

(58) Field of Search ..... 53/52, 55, 550, 53/450, 374.3, 374.5, 376.2

(56) References Cited

U.S. PATENT DOCUMENTS

| | | | | |
|---|---|---|---|---|
| 4,726,168 A | | 2/1988 | Seko | 53/450 |
| 4,776,747 A | * | 10/1988 | Swapp et al. | |
| 4,909,018 A | | 3/1990 | Yamamoto | 53/450 |
| 4,924,657 A | * | 5/1990 | Berti et al. | |
| 4,955,176 A | * | 9/1990 | Seko et al. | |
| 4,964,258 A | * | 10/1990 | Seko et al. | |
| 5,653,085 A | * | 8/1997 | Suga | |
| 5,689,942 A | | 11/1997 | Suga | 53/550 |
| 5,826,403 A | * | 10/1998 | Haley | |
| 5,966,908 A | * | 10/1999 | Philipp et al. | |

FOREIGN PATENT DOCUMENTS

| | | | |
|---|---|---|---|
| DE | 198 13 311 A1 | 10/1998 | B65B/47/00 |
| EP | 0 230 137 A1 | 7/1987 | B65B/59/04 |
| EP | 0 836 996 A1 | 4/1998 | B65B/31/02 |

* cited by examiner

*Primary Examiner*—Eugene Kim
(74) *Attorney, Agent, or Firm*—Mark Kusner; Michael A. Jaffe

(57) ABSTRACT

A method and apparatus for controlling operation of a bag-forming and -filling packing apparatus for supplying unsealed packaged articles (45) to a rotary vacuum packaging machine at regular intervals, in which the rotary vacuum packing machine is subjected to significant variations in loads. A main controller (115) for receiving pulse signals calculates modulation of the pitch of pulses from a main motor (86) of the rotary vacuum packaging machine, and control elements (94, 95, 96, 97) each attached to a corresponding one of all servo motors (20, 30, 40, 76) of the bag-forming and -filling packaging machine individually and simultaneously control the rotation value of each servo motor. This configuration can avoid step-wise control of each servo motor and reduce impacts on a rotary section and a failure rate while maintaining a slow control operation.

6 Claims, 8 Drawing Sheets

METHOD AND APPARATUS FOR CONTROLLING BAG-FORMING AND-FILLING VACUUM PACKAGING MACHINE

FIELD OF THE INVENTION

The present invention relates to a method and apparatus for controlling a rotary vacuum packaging machine that rotates, along an endless track, a large number of pressure-proof chambers each for forming a vacuum space inside, and a bag-forming and -filling packaging machine for feeding an unsealed wrapped article into each pressure-proof chamber of the vacuum packaging machine so that the rotary vacuum packaging machine and the bag-forming and -filling packaging machine operate in synchronism.

BACKGROUND OF THE INVENTION

As disclosed in U.S. Pat. No. 5,347,791, a bag-forming and -filling packaging machine called an "autowrapper" is structured so that band-shaped films rolled around a support shaft are drawn out through a bag former by rotation power of a first motor so as to be formed into a tube. Then, a large number of packaged articles are loaded in the tube film in tandem at regular intervals by means of a conveyor rotated by power of a second motor. Subsequently, the tube film is sequentially seal-cut at a position between each two packaged articles by means of a seal bar rotated by power of a third motor, and are then unloaded as packaged articles. These servo motors are controlled by a controller, that is, an automatic calculation device so that the rotation angles of the first and third motors are controlled based on the rotation angle of the second motor. That is, the bag-forming and -filling packaging machine is structured to simultaneously operate the transfer speed of band-shaped films, a pitch with which the conveyor loads packaged-articles, and the rotation cycle of the seal bar, mutually.

On the other hand, JP-A-8-16941, which has been laid-open in Japan, discloses a rotary vacuum packaging apparatus for transferring unsealed packaged articles sequentially unloaded from a bag-forming and -filling packaging machine, onto surface plates moved along an endless track at regular intervals, subsequently placing a cover member on each of the surface plate, and then vacuum-packaging the packaged article in a pressure-proof chamber formed of the surface plate and the cover member. Operation of each motor of this apparatus is controlled so that reference pulses from a main motor for driving a rotor of the vacuum packaging apparatus synchronize a seal bar power motor with the main motor. Further, pulse signals from the power motor for the seal bar synchronize rotation of a motor for transferring the band-shaped films with rotation of a motor for transferring the packaged articles.

Thus, if loads on the vacuum packaging machine vary to cause a correction signal to be transmitted from a controller to the bag-forming and -filling packaging machine, the rotations of the three motors are corrected step-wise, thereby necessarily resulting in a rapid motor correction operation, which leads to frequent failures.

DISCLOSURE OF THE INVENTION

Thus, it is an object of the present invention to eliminate the master-server relationship among the motors of the bag-forming and -filling packaging machine to allow correction operation for each motor to be slowly performed depending on variations in loads on the vacuum packaging machine, thereby reducing the frequency of failures in the motors.

To attain this object, the present invention is comprised of a rotary vacuum packaging chamber for using a main motor to transport, along an endless track, a large number of pressure-proof chambers arranged at regular intervals, while vacuum-sealing an unsealed packaged article inside each of the pressure-proof chambers being transported, and a pulse generator for converting the rotation angle of the main motor into a pulse signal and inputting it to a main controller, wherein the transportation pitch of the pressure-proof chambers is determined from pulses input to the main controller and wherein in accordance with modulation of the pitch of the pulses, servo motors for operating the bag-forming and -filling packaging machine are simultaneously corrected while uncoupled from one another so that the rotation angles of the individual servo motors agree with the pitch of each pressure-proof chamber.

The main controller obtains pulses generated by a pulse transmitter in order to determine the transportation pitch of the pressure-proof chambers, and synchronizes operation of each servo motor with operation of the main motor so that the transportation pitch of the pressure-proof chambers agrees with each of a film transfer pitch, a packaged-article loading pitch, a sealer driving cycle, and a packaged article unloading pitch in the bag-forming and -filling packaging machine. That is, the rotation of each servo motor is allowed to follow the rotation of the main motor. If a variation in loads on the main motor varies the pulse pitch, the main controller individually transmits an arithmetic-operation signal through each control element to a corresponding one of the servo motors connected to the main controller, so that the rotation of each servo motor is simultaneously controlled by the correction effect of each control element. In summary, since the plurality of servo motors are controlled to follow variations in the motion of the main motor, the speed of each servo motor varies with variations in the motion of the main motor caused by variations in loads thereon. Compared to the conventional control shown in "Background of the Invention" as correcting motion step-wise, the present configuration requires only one-step operation, thereby improving the failure rate.

DESCRIPTION OF THE EMBODIMENTS

Figure 2:
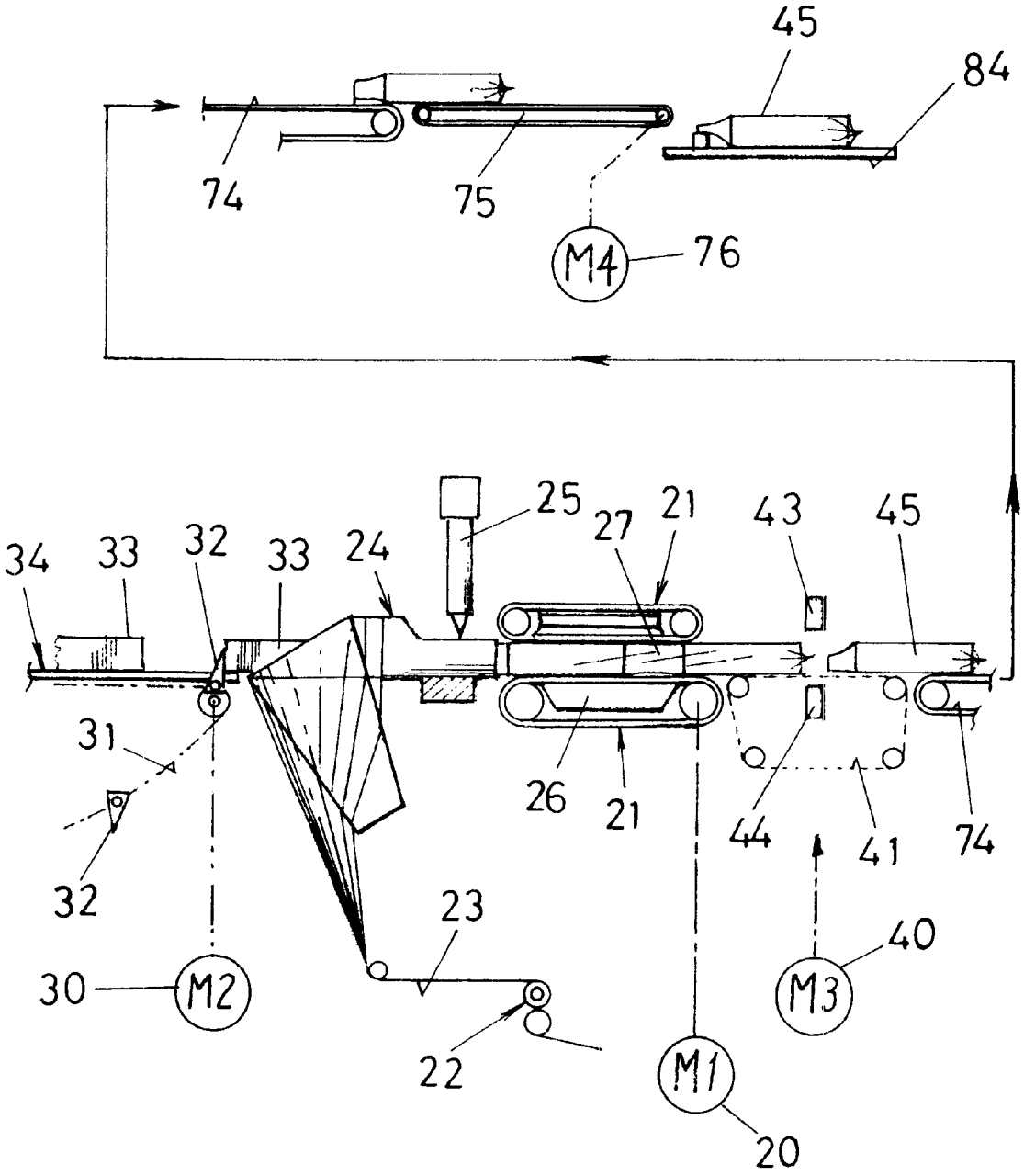
FIG. 2 is a side view of a bag-forming and -filling packaging machine constituting part of the apparatus.

FIG. 2 shows a bag-forming and -filling packaging machine. A band-shaped film 23 is drawn by rotation of a vertical pair of endless belts 21 operated by a first servo motor 20 and by rotation of a feeding roll 22. The film 23 is deformed on passing through channel-shaped cylinder-forming means 24, and has its overlap portions at opposite side edges thereof welded by an ultrasonic seal machine 25 so as to be formed into a tube. In this case, to increase tensile force applied to the film 23 by the endless belts 21, a vacuum tank 26 brings a tube film 27 in tight contact with the belts 21 through a large number of holes formed therein.

On the other hand, an endless chain conveyor 31 rotated by power of a second servo motor 30 is comprised of attachments 32 spaced at regular intervals for loading each article 33 in the tube film 27 along a top surface of a smooth guide plate 34.

Figure 3:
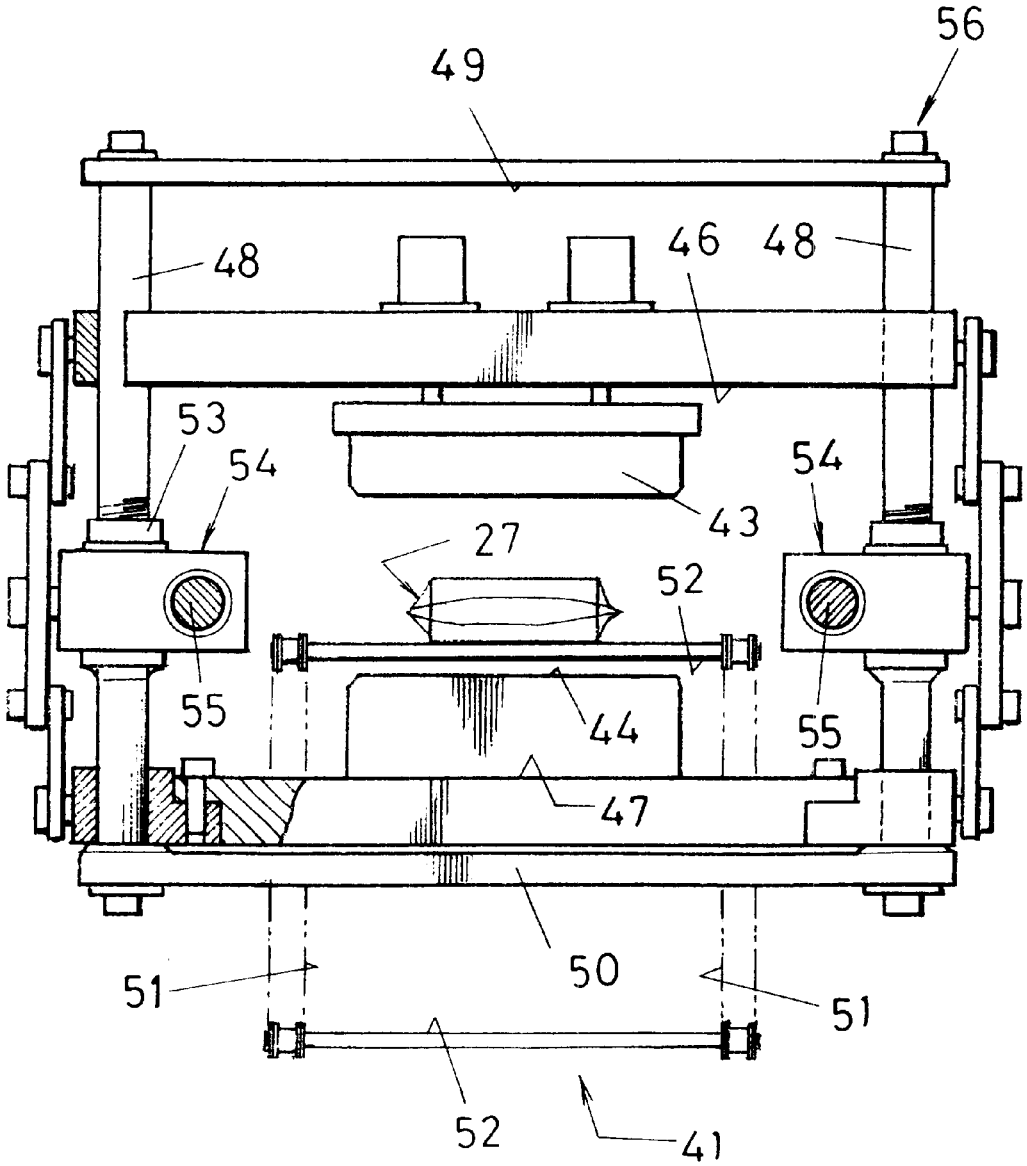
FIG. 3 is a front view of a seal device portion of the bag-forming and -filling packaging machine.

Furthermore, a cross bar conveyor 41 located behind the tension belt 21 and having a large number of bar members extended between a lateral pair of endless chains is rotated by power of a third motor 40. A pair of sealers 43, 44 cuts and seals the tube film transferred on the conveyor to form bags, whereby unsealed packaged articles 45 with articles contained therein are sequentially fed. The detailed construction of the corresponding portion of the apparatus is shown in FIG. 3.

Figure 4:
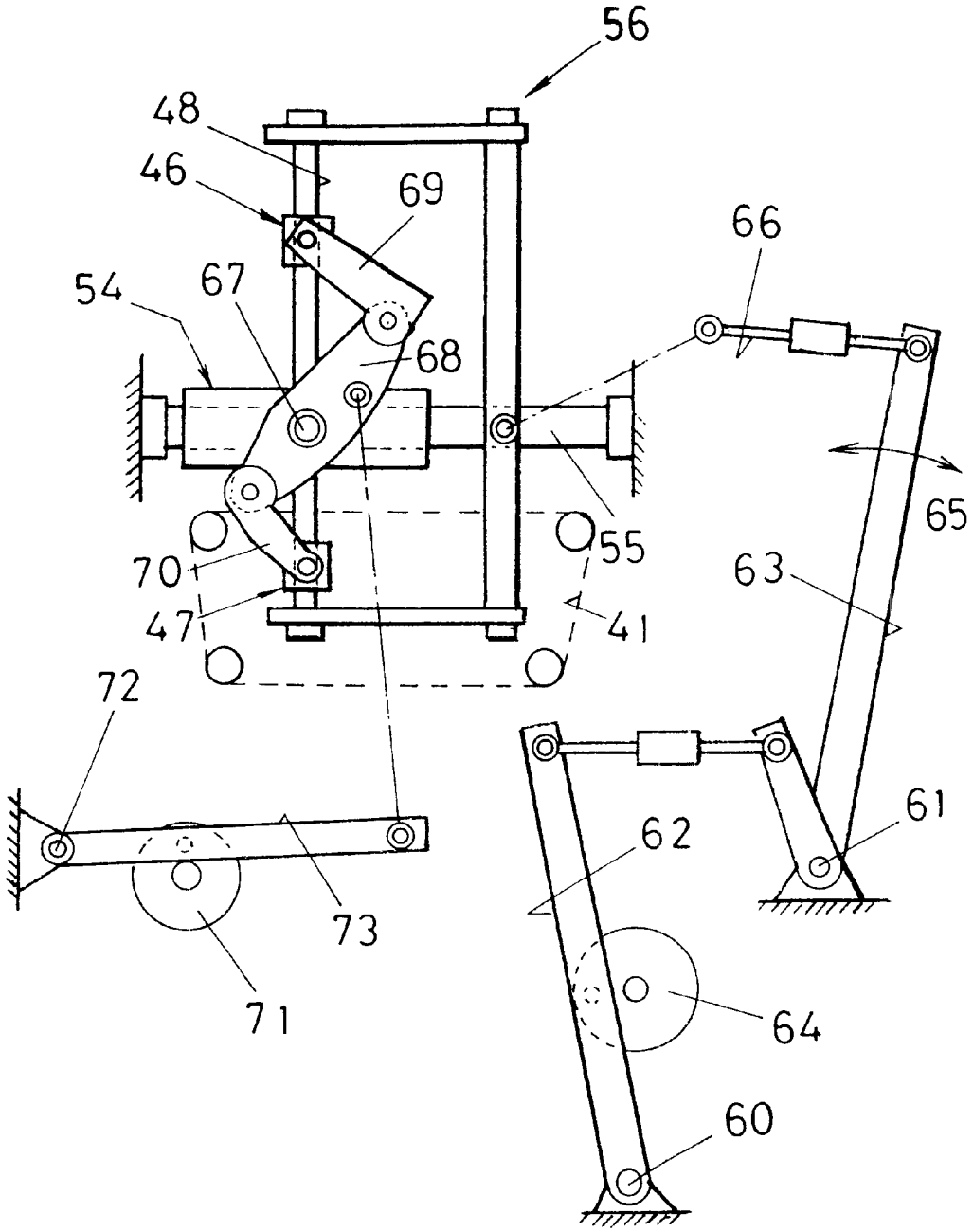
FIG. 4 is a side view of FIG. 3.

That is, a vertical pair of frame members 46, 47 individually supporting the upper and lower seal bars 43, 44 have its opposite ends supported for sliding in a vertical direction along a lateral pair of round-column-shaped guide bars 48. The guide bars 48 have their vertical ends coupled together in the form of a frame by means of stays 49, 50. The cross bar conveyor 41 has a large number of cross bars 52 extended in parallel between a pair of endless chains 51 arranged in a fashion surrounding the lower frame member 47, so that the upper and lower seal bars 43, 44 cut and seal the tube film 27 at the gap between each two cross bars 52. On the other hand, a block 54 tightened and fixed with a nut 53 at an intermediate position of each of the guide bars 48 located on the opposite side edges is slidably supported by a horizontal guide 55, thereby allowing a frame 56 to reciprocate along the horizontal guides 55 at the same speed as the tube film 27. FIG. 4 shows the operational configuration of the apparatus as described above.

As shown in FIG. 4, by rotating a grooved cam 64, a first lever 62 and a second lever 63 each having its lower end supported to the apparatus body via a pin 60, 61 are operated in a direction shown by arrow 65, in an interlocking manner. The frame 56, which is connected to the lever 63 via a connecting rod 66, is displaced in the same direction as the conveyor 41 at the same speed as the conveyor 41 before returning in the opposite direction. In addition, a bell crank 68 is rotatively supported on a pin 67 protruding from a side of the block 54, and has its opposite ends connected to the vertical pair of frame members 46, 47 via links 69, 70, respectively. Since the bell crank 68 by rotating the second grooved cam 71 is oscillated by a lever 73 that moves in a vertical direction using one end 72 as a shaft, the seal bars fixed to the upper and lower frame members 46, 47 cut and seal the tube film. The two grooved cams 64, 71 are coaxially arranged and rotated by the third motor 40 in FIG. 2.

As shown in FIG. 2, the unsealed packaged article 45, which has been cut and sealed, is transferred from the cross bar conveyor 41 onto a first unloading conveyor 74. The first conveyor 74 moves slightly faster than the cross bar conveyor 41, and this speed serves to enlarge the gap between the unsealed packaged articles. An unloading conveyor 75 is located above the cross bar conveyor, as shown by the arrow in FIG. 2 to save space. A fourth motor 76 operating the second unloading conveyor 75 controls it so that the speed at which the unsealed packaged article 45 agrees with the speed of a surface plate 84, thereby accurately transferring the unsealed packaged article 45 onto the surface plate 84 at a specified position.

Figure 5:
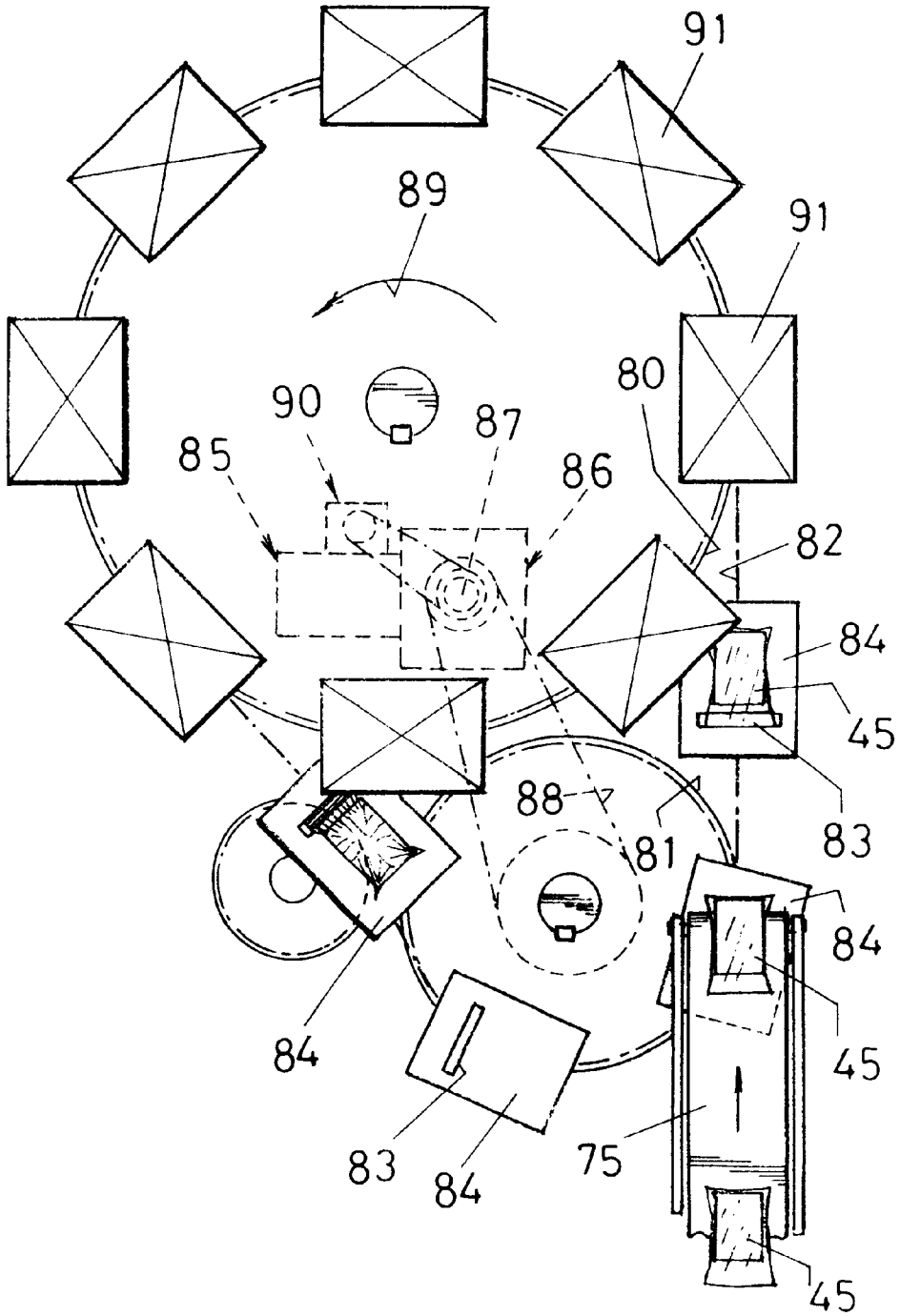
FIG. 5 is a top view of a vacuum packaging machine constituting part of the apparatus.
Figure 6:
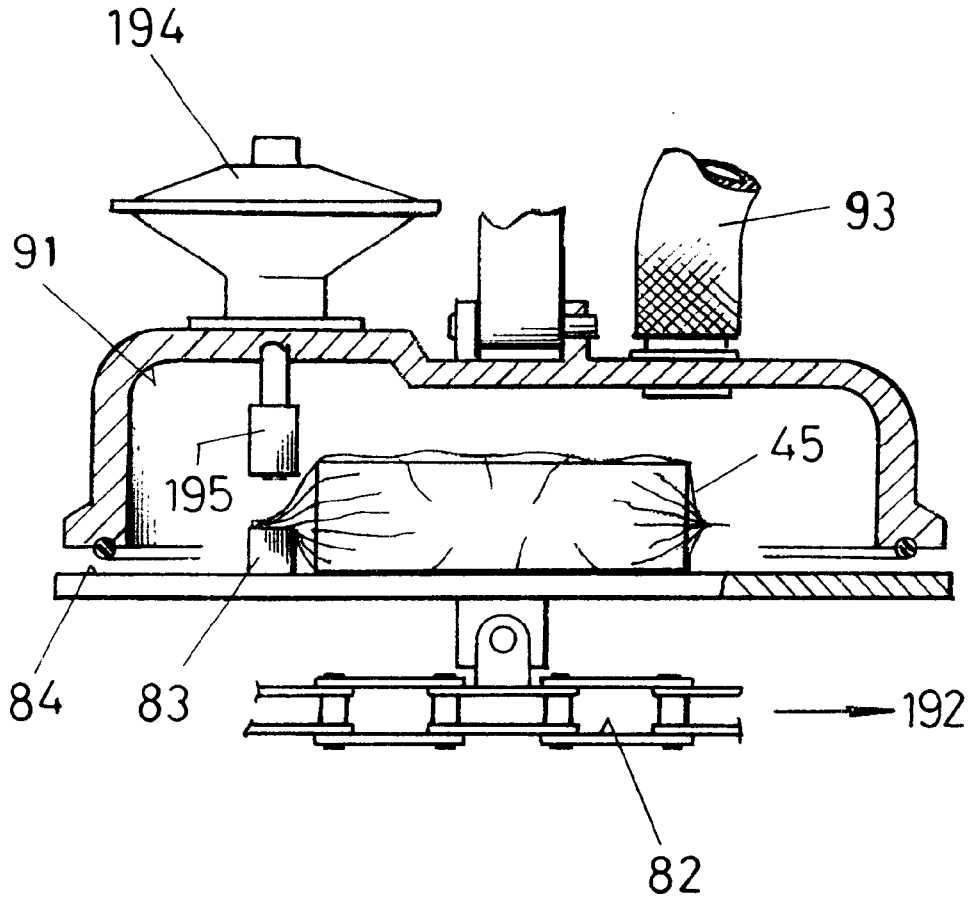
FIG. 6 is a side sectional view of a pressure-proof chamber of the vacuum packaging machine.

As shown in FIG. 5, the vacuum packaging machine has 10 surface plates 84 attached at regular intervals to an endless chain 82 engaging with peripheral portions of rotors 80, 81 formed of a larger and a smaller gears. On the other hand, the large rotor 80 has a main motor 86 installed thereunder and connected to an inverter 85 for transmitting rotation power of a shaft 87 of the main motor 86 to the small rotor 81 via an endless transmission band 88. Accordingly, each of the surface plates 84 moves along an endless track around both rotors to receive the packaged article 45 carried by the second unloading conveyor 75, at a specified position. In addition, the large rotor 80 is comprised of eight cover members 91 moving at the same speed as the surface plates 84. The cover member 91, which is shaped like an inverted bowl as shown in FIG. 6, moves in the direction shown by arrow 192, while coming in tight contact with a top surface of the surface plate 84 to confine the unsealed packaged article 45 in an airtight chamber. Subsequently, air is sucked up from the chamber through a flexible tube 93. Once sucking has been completed, an actuator 194 lowers a seal member 195 toward a seal table 83, where the unsealed packaged article has its opening heated and sealed.

Figure 1:
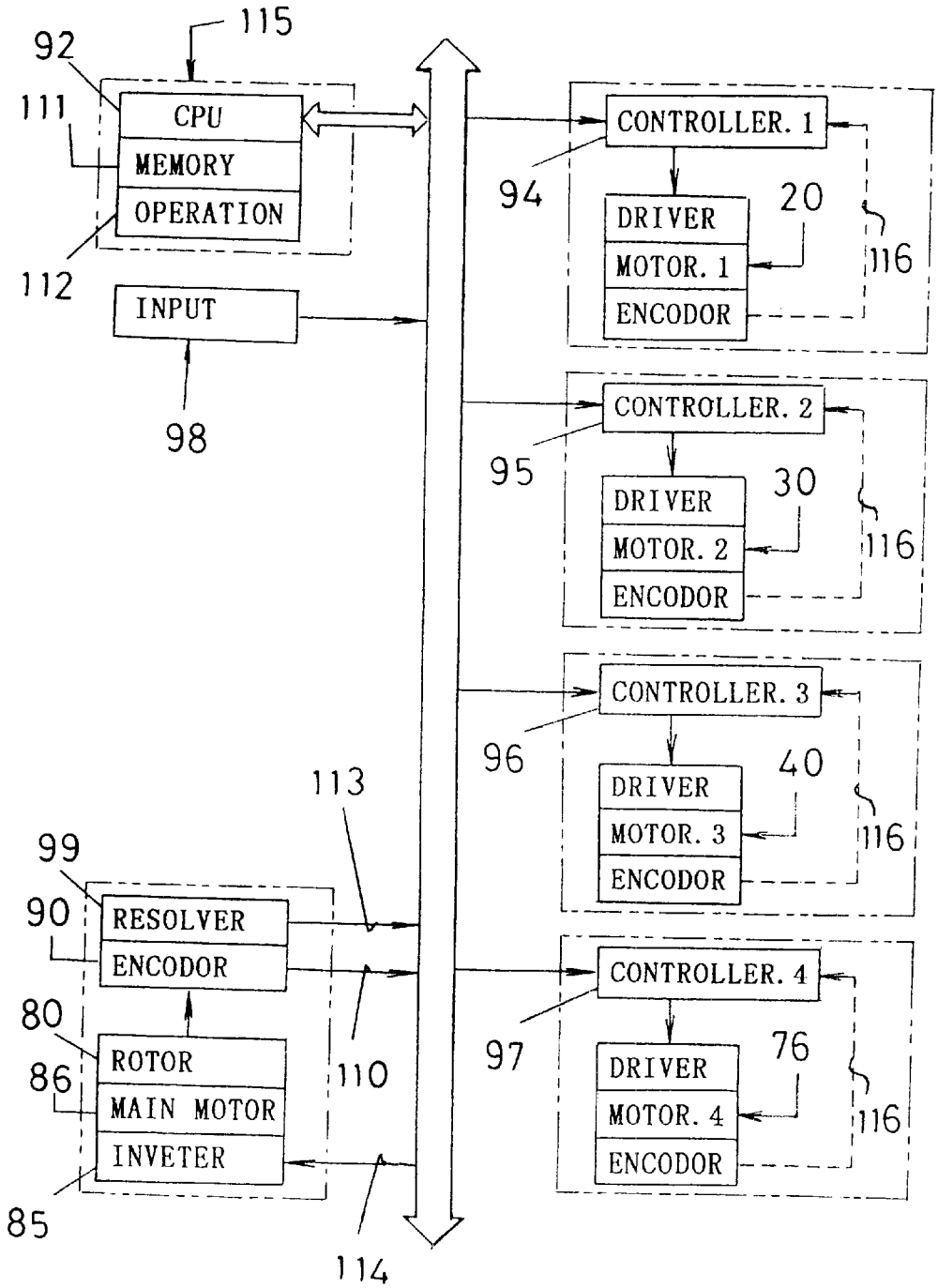
FIG. 1 is a block diagram of an entire apparatus showing only essential components thereof.

FIG. 1 shows a control configuration of the packaging apparatus in FIGS. 2 and 5 in a block diagram. As shown in this figure, when driven by power of the main motor 86, the rotor 80 simultaneously actuates a pulse generator 90. The pulse generator 90 then generates a pulses which is input to a main controller 115 through a circuit 110. Simultaneously with this input, the main controller 115 receives an output signal 113 from a resolver 99 to constantly checks the rotation angle of the rotor 80, that is, the current position of the pressure-proof chamber.

Figure 7:
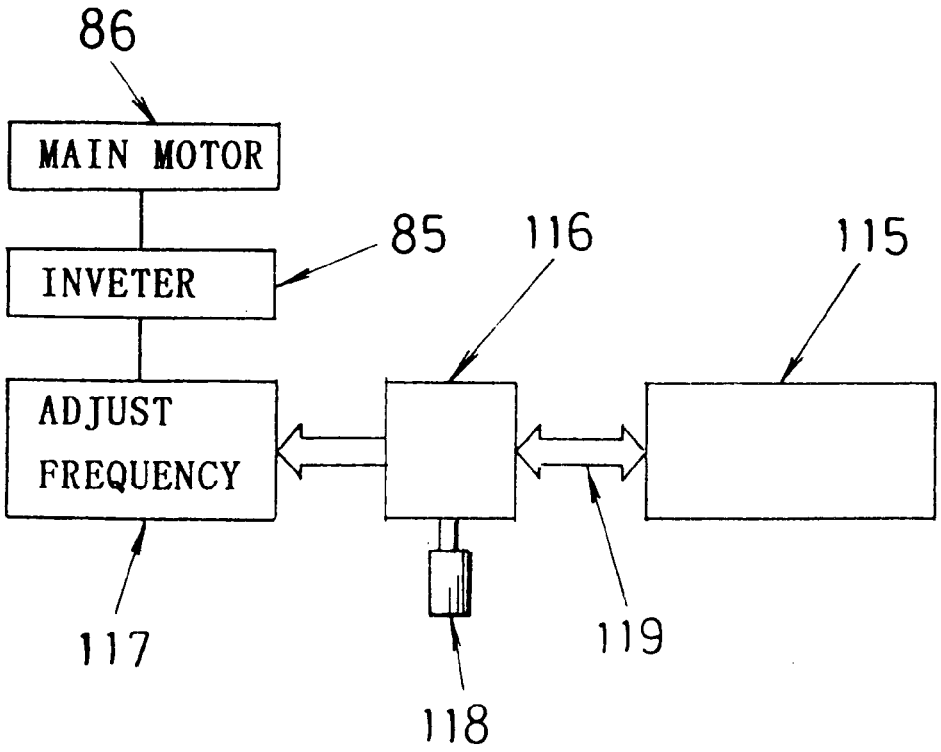
FIG. 7 is an explanatory drawing of a speed regulator for a main motor.

When an operator provides an instruction for the main controller 115 through an input device 98, this signal is transmitted via a circuit 114 to an inverter 85, which then sets a speed of the main motor 86 depending on the value of the frequency of the signal. FIG. 7 is a specific block diagram showing this control. An indication signal 119 from the main controller 115 is sent to the inverter 85 through an operation device 116 and a frequency adjuster 117. The operation device 116 can be directly operated with a dial 118. Once this operation has stabilized the rotation of the main motor 86, the surface plates 91 theoretically pass through a specified point, for example, every 1,000 pulses. If, however, the main motor 86 is affected by loads, the passage pitch of the surface plates 91 becomes irregular.

Figure 8:
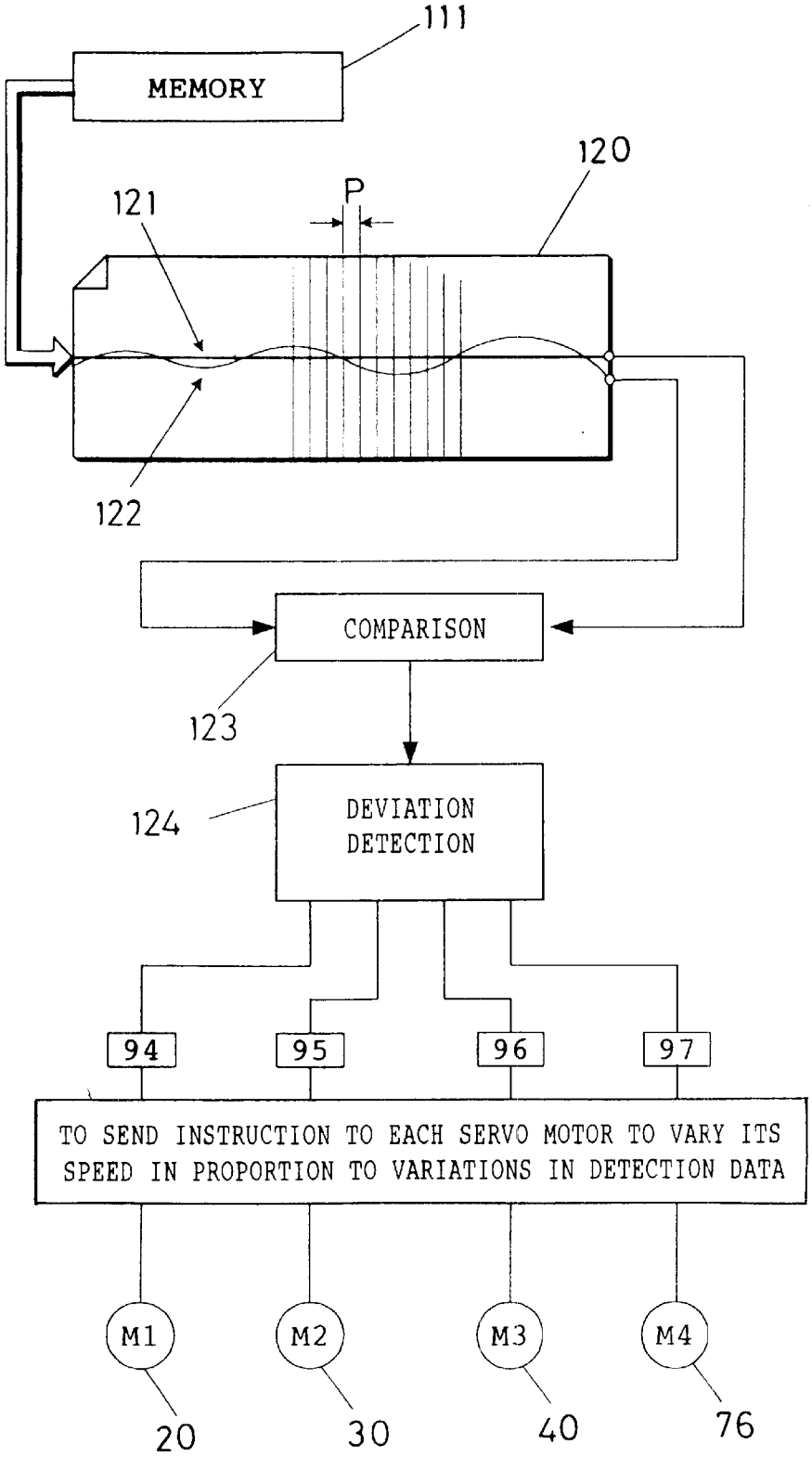
FIG. 8 is an explanatory drawing of a control effect.

That is, while the rotation of the rotor 80 in FIG. 1 is monitored by a central control section 92 for inputting pulse signals, of course this monitoring includes variations in the rotation of the rotor 80 caused by loads. Since variations in the speed of the main motor 86 caused by heavy rotor loads constantly modulate the pitch of pulses 110, the main controller 115 compares such variations in pulse pitch with information stored in a memory 111, calculates a deviation value using arithmetic operation means 112, and transmits the result to four control elements 94 to 97. This state is shown in FIG. 8. Although pulse pitches P stored in the memory 111 are at regular intervals as shown by a straight line 121 on a sheet 120, pulses 122 generated by the pulse generator are modulated in the form of waves due to loads. The main controller 115 compares these two pulses together (123), and the arithmetic operation means 112 detects a deviation between the two pulses based on the comparison and subsequently transmits detection data to the four control elements 94, 95, 96, 97. Then, the control elements 94, 95, 96, 97 each send an instruction signal to a corresponding one of the servo motors 20, 30, 40, 76 so as to change its speed. In summary, based on the arithmetic-operation signal from the main controller 115, the control elements 94, 95, 96, 97 control the pitch with which the first motor 20 unloads the film 23, the pitch with which the second motor 30 loads the articles 33 in the film, the cycle with which the third motor 40 operates the seal bars 43, 44, and the pitch with which the fourth motor 76 unloads the packaged articles 45 so that these pitches are proportional to the transfer pitch of the surface plates 84.

When an input device 98 is used to inform the central control section 92 of a change in the length of the packaged article, the first control element 94 controls the speed at which the first motor 20 unloads the film 23, depending on the value of the length of the packaged article, while the third control element 96 varies the cycle with which the third motor 40 operates the sealers so as to correspond to variations in the speed of the film 23. In this case, the rotation of the second or fourth motor 70 or 76 does not vary. If, however, the input device 98 is used to vary the output frequency of the inverter 85, the four control elements 94, 95, 96, 97 each adjust a corresponding one of the motors 20, 30, 40, 76 so as to correspond to a corresponding change in the transfer pitch of the surface plates 84. The first to fourth motors 20, 30, 40, 76 each include a feedback circuit 116 between the motor and a corresponding one of the control elements.

What is claimed is:

1. In a rotary vacuum packaging machine for sequentially transferring unsealed packaged articles fed from a bag-forming and -filling packaging machine at regular intervals onto pressure-proof chambers that move along an endless track at regular intervals by means of rotation of a rotor driven by a main motor, and for vacuum-sealing said unsealed packaged article inside each of said moving pressure-proof chambers, wherein individual servo motors respectively operate a corresponding component of the bag-forming and filling packaging machine, the individual servo motors including a first motor for transferring a band-shaped film to form it into a tube through cylinder-forming means, a method for controlling operation of the bag-forming and filling vacuum packaging machine, comprising the steps of:

using a main controller for calculating a number of pulses generated by said main motor in order to monitor a transfer pitch of said pressure-proof chambers based on said number of pulses; and sending an arithmetic-operation signal to each control element connected to a corresponding one of the individual servo motors each operating a corresponding component of said bag-forming and -filling packaging machine, in order to simultaneously correct the servo motors so that their rotations are constantly proportional to variations in the transfer pitch of said pressure-proof chambers caused by variations in loads on said rotor, so that rotation of each said individual servo motor operating a corresponding component of the bag-forming and filling packaging machine is controlled so as to be proportional to the transfer pitch of said pressure-proof chambers.

2. The method for controlling operation of a bag-forming and -filling vacuum packaging machine according to claim 1, wherein the individual servo motors operating a corresponding component of the bag-forming and filling packaging machine includes:

a second motor for driving a conveyor for loading articles to be packaged in said tube film from an inlet of said cylinder-forming means at regular intervals;

a third motor for driving a sealer located behind said cylinder-forming means relative to a direction in which the tube film is transferred, the sealer cutting and sealing said tube film between the articles; and a fourth motor for driving a conveyor located behind said sealers for unloading the articles fed from the sealers, and wherein:

a pitch with which said band-shaped film is transferred, a pitch with which the articles are loaded in said tube film, a pitch with which said tube film is cut, and a pitch with which cut unsealed packaged articles are unloaded are controlled so as to be proportional to the transfer pitch of said pressure-proof chambers.

3. A bag-forming and -filling vacuum packaging apparatus comprising:

a first motor for transferring a band-shaped film to form it into a tube through cylinder-forming means;

a second motor for driving a conveyor for loading articles in said tube film from an inlet of said cylinder-forming means at regular intervals;

a third motor for driving a sealer located behind said cylinder-forming means relative to a direction in which the tube film is transferred, the sealer cutting and sealing said tube film between the articles; and a fourth motor for driving a conveyor located behind said sealers for unloading the articles fed from the sealers; and a main motor 86 for driving the rotor located at a terminal of said unloading conveyor for transporting vacuum pressure-proof chambers in the transfer direction of the conveyor, wherein the apparatus includes:

control means for allowing a main controller to obtain a pulse generated by a pulse transmitter connected to a shaft of said rotor in order to determine the transportation pitch of the pressure-proof chambers, and synchronizing operation of said first to fourth motor with operation of said main motor so that the transportation pitch of the pressure-proof chambers agrees with each of a pitch with which said film is transferred, a pitch with which said articles are loaded, a cycle with which said sealers are driven, and a pitch with which said articles are unloaded; and means for sending a correction signal through first to fourth control elements to each of said first to fourth motors individually connected to a corresponding one of the control elements to simultaneously control the rotation of each motor, in response to a variation in pulse pitch caused by a variation in loads on said main motor.

4. The apparatus according to claim 3, wherein an inverter connected a frequency adjuster sets a rotation speed of the main motor.

5. The apparatus according to claim 4, wherein the frequency adjuster is operated by means of electric signals sent from an input device to an operation device through the main controller.

6. In a rotary vacuum packaging machine for sequentially transferring unsealed packaged articles fed from a bag-forming and -filling packaging machine at regular intervals onto pressure-proof chambers that move along an endless track at regular intervals by means of rotation of a rotor driven by a main motor, and for vacuum-sealing said unsealed packaged article inside each of said moving pressure-proof chambers, a method for controlling operation of the bag-forming and -filling vacuum packaging machine, comprising the steps of:

using a main controller for calculating a number of pulses generated by said main motor in order to monitor a transfer pitch of said pressure-proof chambers based on said number of pulses;

sending an arithmetic-operation signal to each control element connected to a corresponding one of individual servo motors each operating a corresponding component of said bag-forming and -filling packaging machine, in order to simultaneously correct the servo motors so that their rotations are constantly proportional to variations in the transfer pitch of said pressure-proof chambers caused by variations in loads on said rotor, wherein the individual servo motors operating a corresponding component of the bag-forming and -filling packaging machine include:

a first motor for transferring a band-shaped film to form it into a tube through cylinder-forming means;

second motor for driving a conveyor for loading articles to be packaged in said tube film from an inlet of said cylinder-forming means at regular intervals;

a third motor for driving a sealer located behind said cylinder-forming means relative to a direction in which the tube film is transferred, the sealer cutting and sealing said tube film between the articles; and a fourth motor for driving a conveyor located behind said sealers for unloading the articles fed from the sealers, and wherein:

a pitch with which said band-shaped film is transferred, a pitch with which the articles are loaded in said tube film, a pitch with which said tube film is cut, and a pitch with which cut unsealed packaged articles are unloaded are controlled so as to be proportional to the transfer pitch of said pressure-proof chambers.

* * * * *